US011607886B2

(12) United States Patent
Tow et al.

(10) Patent No.: US 11,607,886 B2
(45) Date of Patent: Mar. 21, 2023

(54) INK TANK WITH INTEGRATED FILTER

(71) Applicant: Memjet Technology Limited

(72) Inventors: Gregory Tow, North Ryde Nsw (AU); Patrick McAuliffe, North Ryde Nsw (AU); Zhenya Yourlo, North Ryde (AU)

(73) Assignee: Memjet Technology Limited

( * ) Notice: Subject to any disclaimer, the term of this patent is extended or adjusted under 35 U.S.C. 154(b) by 67 days.

(21) Appl. No.: 17/202,804

(22) Filed: Mar. 16, 2021

(65) Prior Publication Data

US 2021/0291537 A1 Sep. 23, 2021

Related U.S. Application Data

(60) Provisional application No. 62/990,911, filed on Mar. 17, 2020.

(51) Int. Cl.
*B41J 2/175* (2006.01)

(52) U.S. Cl.
CPC ..... *B41J 2/17513* (2013.01); *B41J 2/17553* (2013.01); *B41J 2/17563* (2013.01); *B41J 2/17566* (2013.01); *B41J 2002/17576* (2013.01)

(58) Field of Classification Search
CPC B41J 2/17513; B41J 2/17553; B41J 2/17563; B41J 2/17566; B41J 2002/17576; B41J 2/18; B41J 2/19; B41J 2/195; B41J 2/175
USPC ..... 347/93
See application file for complete search history.

(56) References Cited

U.S. PATENT DOCUMENTS 5,742,311 A * 4/1998 Koitabashi ..... B41J 2/17556 347/100
2003/0007049 A1* 1/2003 Hino ..... B41J 2/19 347/92
2004/0056918 A1* 3/2004 Wang ..... B41J 2/19 347/22
2004/0246317 A1* 12/2004 Hayashi ..... B41J 2/17513 347/86

* cited by examiner

*Primary Examiner* — Matthew Luu
*Assistant Examiner* — Alexander D Shenderov
(74) *Attorney, Agent, or Firm* — Cooley LLP

(57) ABSTRACT

An ink tank for an ink delivery system includes: a housing having an ink inlet port and an ink outlet port; an air vent communicating with a headspace of the ink tank; a filter positioned in the housing for filtering ink supplied from the ink tank via the ink outlet port; and a baffle plate positioned in the housing between the ink inlet port and the filter. The baffle plate is configured for directing air bubbles entering the ink tank via the ink inlet port towards the headspace of the ink tank. A baffle opening is positioned towards a base of the ink tank, thereby allowing ink to flow from the ink inlet port towards the ink outlet port via the baffle opening.

17 Claims, 3 Drawing Sheets

INK TANK WITH INTEGRATED FILTER

CROSS REFERENCE TO RELATED APPLICATIONS

This application claims priority to and the benefit of U.S. Provisional Patent Application No. 62/990,911, entitled INK TANK WITH INTEGRATED FILTER, filed on Mar. 17, 2020, the disclosure of which is incorporated herein by reference in its entirety for all purposes.

FIELD OF THE INVENTION

This invention relates to an ink tank having an integrated filter for an ink delivery system in an inkjet printer. It has been developed primarily for minimizing problems associated with air bubbles in the ink delivery system.

BACKGROUND OF THE INVENTION

Inkjet printers employing Memjet® technology are commercially available for a number of different printing formats, including small-office-home-office ("SOHO") printers, label printers, digital inkjet presses and wideformat printers. Memjet® printers typically comprise one or more stationary inkjet printheads, which are user-replaceable. For example, a desktop printer may comprise a single user-replaceable multi-colored or monochrome printhead, a high-speed digital press may comprise a plurality of user-replaceable monochrome printheads aligned along a media feed direction, and a wideformat printer may comprise a plurality of user-replaceable printheads in a staggered overlapping arrangement so as to span across a wideformat pagewidth.

Ink is supplied to an inkjet printhead via an ink delivery system, which is designed primarily for delivering ink to the printhead at a predetermined hydrostatic pressure. Ink delivery systems also typically include an ink filter for filtering particulates from the ink.

Air bubbles are a perennial problem in inkjet printers. Air bubbles that reach inkjet nozzles can block nozzles and cause catastrophic deprime events. Air bubbles can also reduce the efficacy of ink filters in the ink delivery system by blocking microscopic pores in the filter material. Air bubbles can also affect the operation of ink level sensors, for example, by sticking to a float sensor and increasing its buoyancy, thereby resulting in a potential false ink level reading.

To some extent, the problems associated with air bubbles can be mitigated through the use of degassed ink in a closed ink delivery system. However, such ink delivery systems are not immune to the problems of air bubbles even when degassed ink is employed. For example, air may be intentionally introduced into the ink delivery system via printhead depriming operations when air is drawn through the printhead so that the printhead can be replaced with minimal ink fouling. This introduced air can circulate around the ink delivery system and cause problems, such as blocking an ink filter. If the ink filter becomes catastrophically blocked with air bubbles, it will require replacement by the user which is both inconvenient and time-consuming.

In some ink delivery systems described in the prior art, the ink filter is connected to a de-aeration pump, which removes air from the filter chamber housing the filter material. The de-aeration pump ensures that any air bubbles trapped in the ink filter can escape to atmosphere without causing long-term problems through continuous build-up of air bubbles. However, de-aeration pumps add to the cost and complexity of ink delivery systems.

WO2019/011705 describes an ink filter which passively de-aerates via an air-permeable tube under positive ink pressure.

It would therefore be desirable to provide an ink tank having an integrated filter, which minimizes ingress of air bubbles into the filter. It would further be desirable to provide an ink tank, which allows efficient removal of air bubbles. It would further be desirable to provide an ink tank having an ink level sensor whose operation is not affected by air bubbles in the ink.

SUMMARY OF THE INVENTION

In a first aspect, there is provided an ink tank for an ink delivery system comprising:

a housing having an ink inlet port and an ink outlet port;

an air vent communicating with a headspace of the ink tank;

a filter positioned in the housing for filtering ink supplied from the ink tank via the ink outlet port; and a baffle plate positioned in the housing between the ink inlet port and the filter, the baffle plate being configured for directing air bubbles entering the ink tank via the ink inlet port towards the headspace of the ink tank, wherein the baffle plate has baffle opening positioned towards a base of the ink tank, thereby allowing ink to flow from the ink inlet port towards the ink outlet port via the baffle opening.

Preferably, the ink tank comprises an upper section and a lower section, the lower section having the ink inlet port and the ink outlet port.

Preferably, the upper section has a greater volume than the lower section.

Preferably, the upper section has a greater cross-sectional area than the lower section.

Preferably, the ink outlet port is positioned in a base of the housing and the filter comprises a filter drum positioned over the ink outlet port.

Preferably, the baffle plate extends from the base of the housing towards a roof of the ink tank.

Preferably, in use, the baffle plate extends into a headspace of the ink tank.

Preferably, the ink inlet port is positioned above the baffle opening.

Preferably, the ink tank further comprises an ink level sensor, wherein the baffle plate is positioned between the ink level sensor and the ink inlet port.

Preferably, the ink level sensor comprises a float level sensor having a stem extending into the ink tank and one or more floats movable along the stem.

Preferably, the air vent communicates with a labyrinthine channel defined in a roof of the ink tank.

In a second aspect, there is provided an ink delivery system for an inkjet printer comprising:

an ink tank as described above;

an ink supply reservoir connected to the ink inlet port via an ink supply line;

an inkjet printhead having a printhead inlet port connected to the ink outlet port via an ink delivery line; and a control system coordinating with the ink tank for controlling a hydrostatic pressure of ink delivered to the printhead.

Preferably, the printhead comprises a printhead outlet port in fluid communication with the ink tank via an ink return line.

Preferably, the ink return line is connected to the ink supply line.

Preferably, the ink delivery system further comprises a pump and an air intake for depriming the printhead.

Preferably, air enters the ink tank via the ink inlet port during printhead depriming and/or printhead priming.

Preferably, the control system is configured to control a height of ink in the ink tank.

Preferably, the control system controls a supply pump in the ink supply line in response to feedback from one or more ink level sensors in the ink tank.

As used herein, the term "ink" is taken to mean any printing fluid, which may be printed from an inkjet printhead. The ink may or may not contain a colorant. Accordingly, the term "ink" may include conventional dye-based or pigment based inks, infrared inks, UV inks, fixatives (e.g. pre-coats, primers, finishers etc.), 3D printing fluids, biological fluids, functional printing fluids (e.g. solar inks, biosensing inks etc.) and the like.

As used herein, the term "printer" refers to any printing device, such as conventional desktop printers, label printers, duplicators, copiers, digital inkjet presses, 3D printers and the like. The printer may be, for example, a sheet-fed or web-fed printing device.

BRIEF DESCRIPTION OF THE DRAWINGS

Embodiments of the present invention will now be described by way of example only with reference to the accompanying drawing, in which.

DETAILED DESCRIPTION OF THE INVENTION

Gravity-Feed Ink Delivery System

A gravity-feed ink delivery system is described hereinbelow as one exemplary use of the ink tank according to the first aspect. However, it will be appreciated that the ink tank according to the first aspect is equally suitable for use in any circulating ink delivery system incorporating an ink filter.

Figure 1:
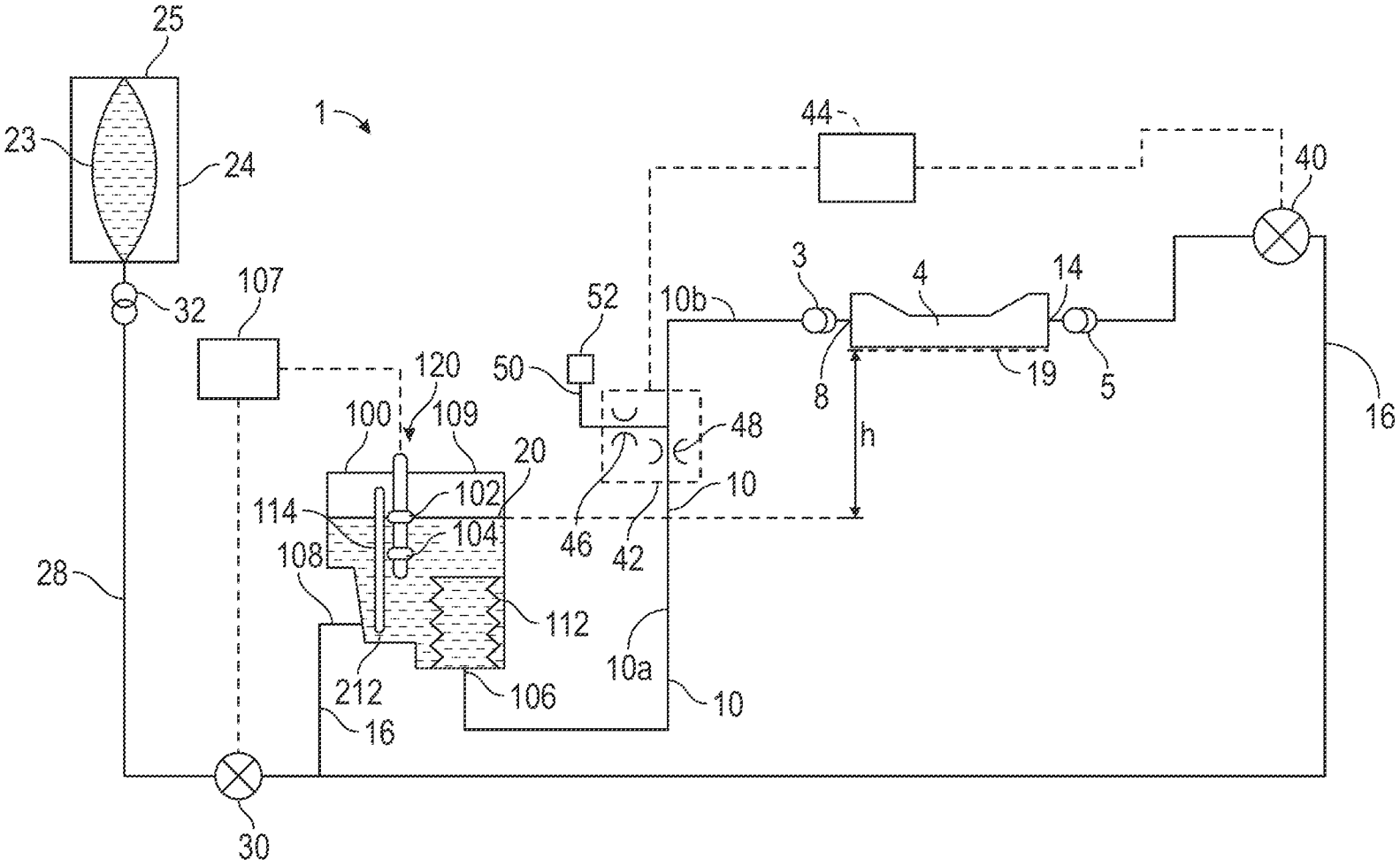
FIG. 1 shows schematically a printer ink delivery system incorporating an ink tank according to the first aspect.

Referring to FIG. 1, there is shown schematically a printer 1 having an ink delivery system for supplying ink to a printhead 4. The ink delivery system is a gravity-feed system, which is similar in function to those described in US2011/0279566 and US2011/0279562, the contents of which are herein incorporated by reference.

The ink delivery system comprises an ink tank 100 having an ink outlet port 106 connected to a printhead inlet port 8 of a printhead 4 via a first ink delivery line 10. An ink inlet port 108 of the ink tank 100 is connected to a printhead outlet port 14 of the printhead 4 via an ink return line 16. Hence, the ink tank 100, the ink delivery line 10, the printhead 4 and the ink return line 16 together form a closed fluidic loop. Typically, the ink delivery line 10 and the ink return 16 are comprised of lengths of flexible tubing, which may be of the same or different diameters. In some embodiments, the ink return line 16 has a smaller diameter than the ink delivery line 10 for efficient air bubble removal, as described in EP2844488B and US2014/0015905, the contents of which are incorporated herein by reference.

The ink tank 100 additionally contains an integrated filter 112 positioned over the ink outlet port 106 for filtering ink delivered to the printhead 4, and a baffle plate 114 positioned between the ink inlet port 108 and the filter 112. The function of the baffle plate 114 is described in further detail below.

The printhead 4 is user-replaceable by means of a first coupling 3 releasably interconnecting the printhead inlet port 8 and the first ink line 10; and a second coupling 5 releasably interconnecting the printhead outlet port 14 and the second ink line 16. The printhead 4 is typically a pagewide printhead and may be, for example, a printhead as described in U.S. Ser. No. 10/399,354 or U.S. Ser. No. 10/293,609, the contents of which are incorporated herein by reference.

Ink 20 contained in the ink tank 100 is open to atmosphere via an air vent 109 positioned in roof thereof. Accordingly, during normal printing, ink is supplied to the printhead 4 at a negative hydrostatic pressure ("backpressure") under gravity. In other words, gravity-feeding of ink from the ink tank 100, which is positioned below the printhead 4, provides a pressure-regulating system for supplying ink to the printhead at a predetermined negative hydrostatic pressure. The amount of backpressure experienced at a nozzle plate 19 of the printhead 4 is determined by the height h of the nozzle plate above a level of ink 20 in the ink tank 100.

Ink is supplied to the ink inlet port 108 of the ink tank 100 from a bulk ink reservoir comprising a collapsible ink bag 23 housed by an ink cartridge 24. The ink cartridge 24 is open to atmosphere via a cartridge vent 25 so that the collapsible ink bag 23 can collapse as ink is consumed by the system. The collapsible ink bag 23 is typically an air-impermeable foil bag containing degassed ink, which is supplied to the ink inlet port 108 via an ink supply line 28 connected to the ink return line 16. The ink cartridge 24 is typically user-replaceable and connected to the ink supply line 28 via a suitable ink supply coupling 32. The ink supply line 28 may comprise an inline ink filter (not shown) for filtering ink before it reaches the ink tank 100.

A control system is used to maintain a substantially constant level of ink in the ink tank 100 and, therefore, a constant height h and corresponding backpressure. As shown in FIG. 1, a supply pump 30 is positioned in the ink supply line 28 and controls a flow of ink from the cartridge 24 into the ink tank 100. The supply pump 30 is operated under the control of a first controller 107, which receives feedback from an ink level sensor 120 having 'high' and 'low' float sensors 102 and 104 (e.g. magnetic float sensors) positioned in the ink tank 100. When the level of ink 20 falls below the low' sensor 104, the first controller 107 signals the supply pump 30 to pump ink into the ink tank 100, and when the level of ink reaches the 'high' sensor 102, the first controller signals the supply pump to stop pumping. In this way, the level of ink 20 in the ink tank 100 can be maintained relatively constant.

The closed fluidic loop, incorporating the ink tank 100, the ink delivery line 10, the printhead 4 and the ink return line 16, facilitates priming, de-priming and other required fluidic operations. The ink return line 16 includes a reversible peristaltic pump 40 for circulating ink around the fluidic loop. By way of convention only, the "forward" direction of the pump 40 corresponds to pumping ink from the ink outlet port 106 to the return port 108 (i.e. clockwise as shown in FIG. 1), and the "reverse" direction of the pump corresponds to pumping ink from the return port 108 to the ink outlet port 106 (i.e. anticlockwise as shown in FIG. 1).

The pump 40 cooperates with a pinch valve arrangement 42 to coordinate various fluidic operations. The pinch valve arrangement 42 comprises a first pinch valve 46 and a second pinch valve 48, and may take the form of any of the pinch valve arrangements described in, for example, US2011/0279566; US2011/0279562; and U.S. Pat. No. 9,180,676, the contents of which are incorporated herein by reference.

The first pinch valve 46 controls a flow of air through an air conduit 50, which is branched from the ink delivery line 10. The air conduit 50 terminates at an air filter 52, which is open to atmosphere and functions as an air intake for the closed fluidic loop.

By virtue of the air conduit 50, the ink delivery line 10 is divided into a first section 10*a* between the ink outlet port 106 and the air conduit 50, and a second section 10*b* between the printhead inlet port 8 and the air conduit 50. The second pinch valve 48 controls a flow of ink through the first section 10*a* of the ink delivery line 10.

The pump 40, the first pinch valve 46 and the second pinch valve 48 are controlled by a second controller 44, which coordinates various fluidic operations. From the foregoing, it will be appreciated that the ink delivery system shown in FIG. 1 provides a versatile range of fluidic operations. Table 1 describes various pinch valve and pump states for some example fluidic operations used in the printer 1. Of course, various combinations of these example fluidic operations may be employed.

TABLE 1

Example Fluidic Operations for Printer 1

| Fluidic Operation | Second Pinch Valve 48 | First Pinch Valve | Pump 40 46 |
|---|---|---|---|
| PRINT | open | closed | off or forward |
| PRIME | open | closed | forward |
| STANDBY | open | closed | off |
| PULSE | closed | closed | reverse |
| DEPRIME | closed | open | forward |
| NULL | closed | closed | off |

During normal printing ("PRINT" mode), the printhead 4 draws ink from ink tank 100 at a negative backpressure under gravity. In this mode, the peristaltic pump 40 may either pump ink forwards around the fluidic loop or alternatively be switched off and function as a shut-off valve. The first pinch valve 46 is closed and the second pinch valve 48 is open to allow ink flow from the ink outlet port 106 to the printhead inlet port 8. During printing, ink is supplied to the ink inlet port 108 of the ink tank 100, under the control of the first controller 107, to maintain a relatively constant ink level 20 and, consequently, a relatively constant backpressure for the printhead 4.

During printhead priming or flushing ("PRIME" mode), ink is circulated around the closed fluidic loop in the forward direction (i.e. clockwise as shown in FIG. 1) with the supply pump off. In this mode, the peristaltic pump 40 is actuated in the forward pumping direction whilst the first pinch valve 46 is closed and the second pinch valve 48 is open to allow ink flow from the ink outlet port 106 to the ink inlet port 108 via the printhead 4. Priming in this manner may be used to prime a deprimed printhead with ink, flush air bubbles from the printhead 4 and/or filter particulates from the ink.

In the "STANDBY" mode, the pump 40 is switched off whilst the first pinch valve 46 is closed and the second pinch valve 48 is open. Usually, the printhead is capped in the standby mode to minimize evaporation of ink from the nozzles (see, for example, US2011/0279519, the contents of which are herein incorporated by reference).

In order to ensure each nozzle of printhead 4 is fully primed with ink and/or to unblock any nozzles which have become clogged, a "PULSE" mode may be employed. In the "PULSE" mode, the first and second pinch valves 46 and 48 are closed, while the pump 40 is actuated in a reverse direction (i.e. anticlockwise as shown in FIG. 1) to force ink through nozzles in the nozzle plate 19 of the printhead 4. The supply pump 30 is off during pulse priming and the ink tank 100 provides a reservoir of ink required for pulse priming. Alternatively, nozzles may be primed using external suction at the nozzle plate 19, as described in, for example, U.S. Provisional Application No. 62/976,213 filed Feb. 13, 2020 ("Method and System for Priming Dry Printheads"), the contents of which are incorporated herein by reference.

In order to replace a spent printhead 4, it is necessary to de-prime the printhead before it can be removed from the printer. In the "DEPRIME" mode, the first pinch valve 46 is open, the second pinch valve 48 is closed and the first pump 40 is actuated in the forward direction to draw in air from atmosphere via the air conduit 50. Depriming displaces ink in the printhead 4 with air and introduces air bubbles into the ink tank 100 via the ink inlet port 108. Once the printhead 4 has been deprimed of ink, the printer is set to "NULL" mode, which isolates the printhead from the ink supply, thereby allowing safe removal thereof with minimal ink spillages.

Ink Tank 100

In a circulatory ink delivery system employing degassed ink, introducing air into the system for printhead depriming and replacement is potentially problematic. Dissolved air is problematic since it may outgas in the printhead, losing the inherent advantages of using degassed ink. Furthermore, non-dissolved air bubbles behave similarly to particulates and can cause blockages in the ink delivery system. Ideally, non-dissolved air bubbles need to be removed from the system before they cause problems such as blocked nozzles in the printhead 4 or blocked ink filters.

Figure 2:
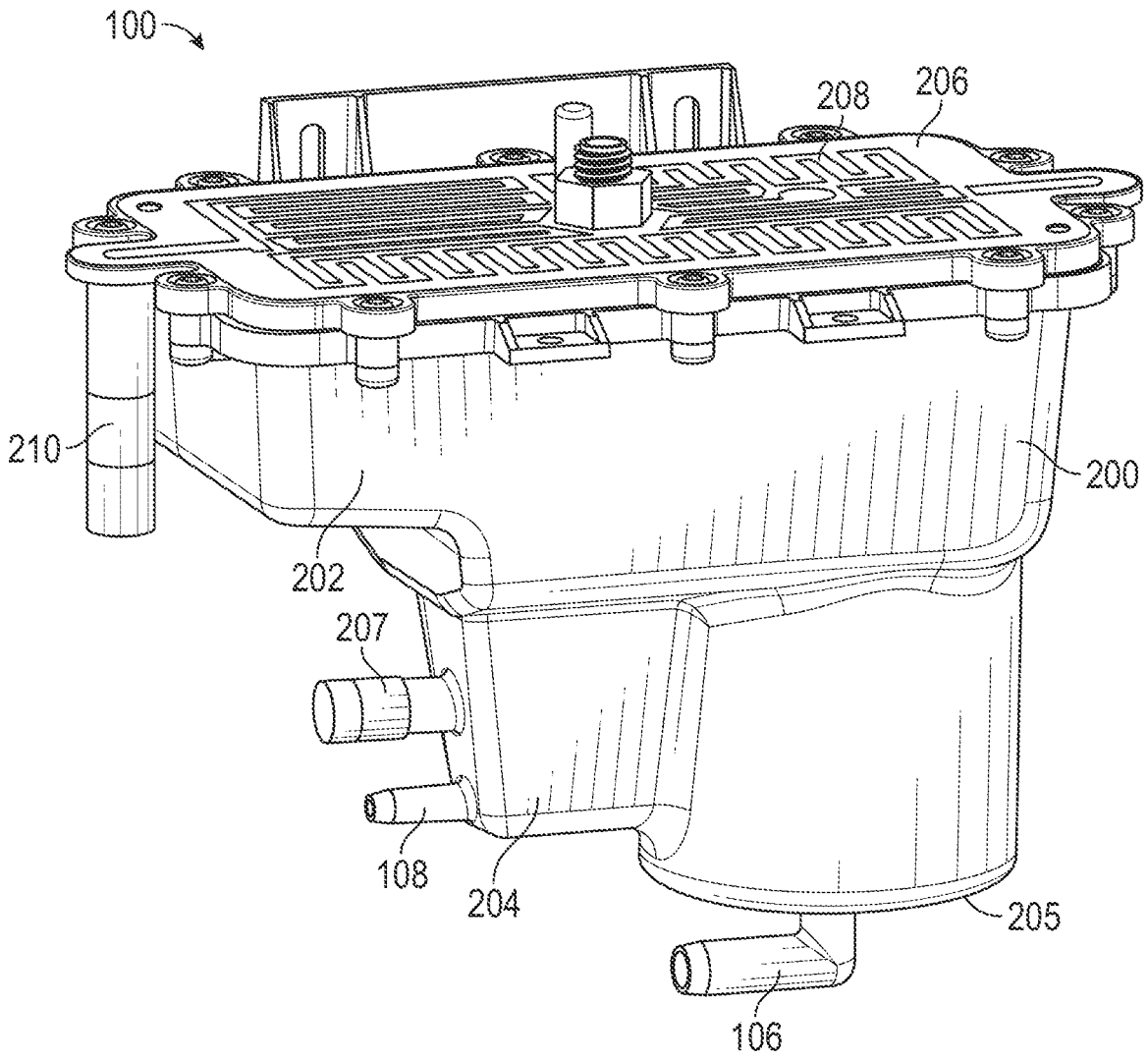
FIG. 2 is a perspective view of an ink tank according to the first aspect.
Figure 3:
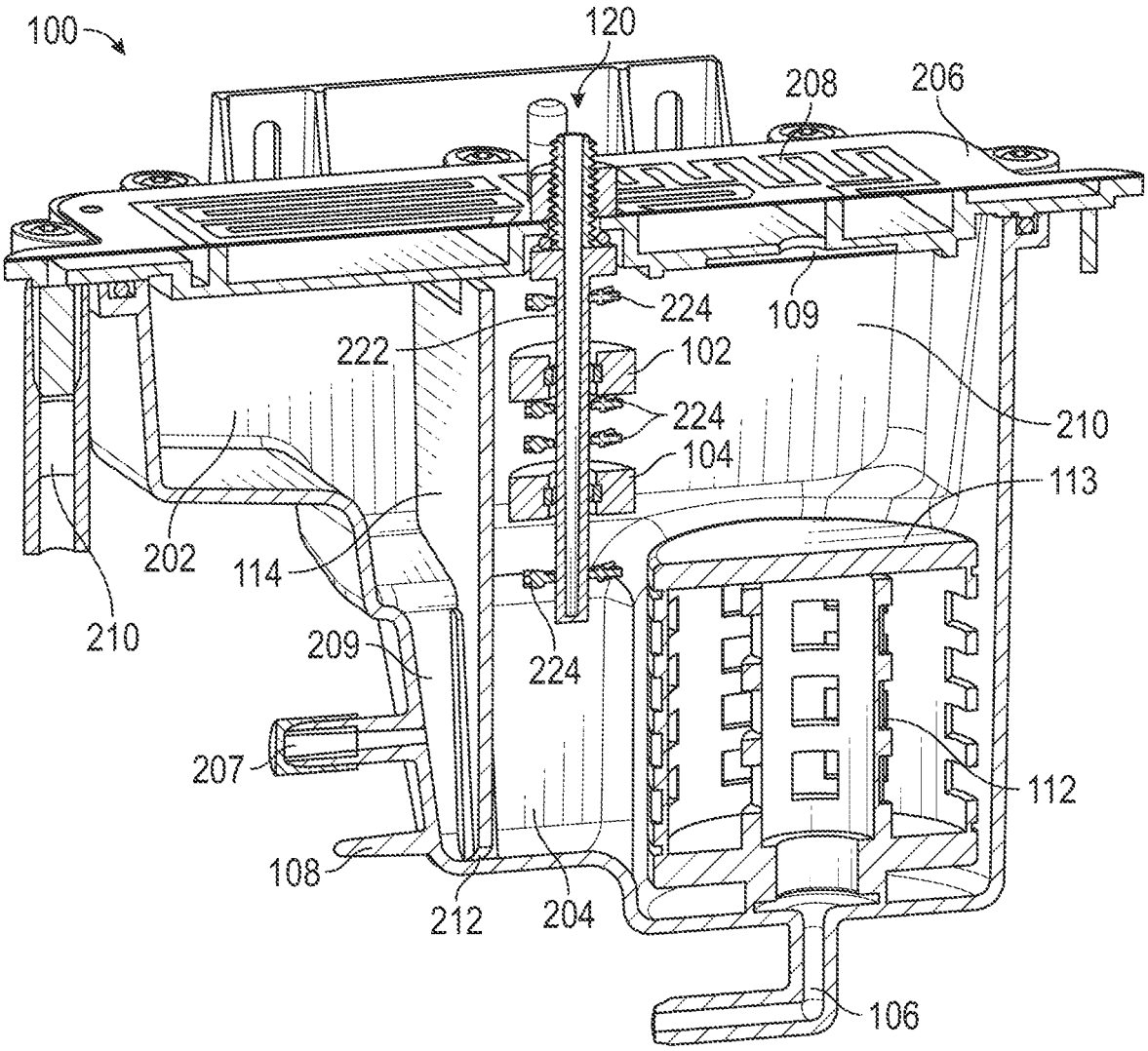
FIG. 3 is a sectional view of the ink tank shown in FIG. 2.

Referring now to FIGS. 2 and 3, the ink tank 100 is designed to facilitate pressure regulation, ink circulation, filtration and removal of air bubbles from the ink delivery system. The ink tank 100 comprises a housing 200, typically formed of molded plastics, which defines an upper section 202 and a lower section 204 of the ink tank.

The lower section 204 includes a truncated cylindrical portion 205 for accommodating the filter 112, which takes the form of a cylindrical filter drum 113. The filter drum 113 is positioned over the ink outlet port 106 at a base of the housing 200 for delivering filtered ink to the printhead 4.

The ink inlet port 108 is positioned at a sidewall of the lower section 204, such that all ink entering the ink tank 100 via the ink inlet port is filtered by the filter 112 before exiting the ink tank via the ink outlet port 106. (An additional connection port 207, which is capped in FIGS. 2 and 3, is provided for the option of fluidically connecting multiple ink tanks 100 together if required).

A lid 206 is fastened to an upper part of the housing 200 to define a roof of the ink tank 100. The lid 206 defines the air vent 109 communicating with a headspace of the ink tank 100 as well as a labyrinthine channel 208 connected to the air vent. A vent port 210 open to atmosphere extends downwardly from the lid 206 and communicates with the headspace of the ink tank 100 via the labyrinthine channel 208 and the air vent 109. The labyrinthine channel 208 functions to minimize evaporation of water from the ink tank 100 whilst allowing air to vent therethrough.

The baffle plate 114 extends upwards from the base of the ink tank 100 towards the lid 206 and is positioned between the ink inlet port 108 and the filter 112. Typically, the baffle plate 114 is an insert slidably received in the molded housing 200. The baffle plate 114 effectively partitions the ink tank 100 into a first side 209 having the ink inlet port 108 and a second side 210 having the filter 112 and the ink outlet port 106.

A lower portion of the baffle plate 114 defines a baffle opening 212 which allows the passage of ink from the ink inlet port 108 at the first side 209 towards the filter 112 at the second side 210 via the lower section 204 of the ink tank 100. The ink inlet port 108 is positioned above the baffle opening 212 such that any air bubbles entering the ink tank 100 via the ink inlet port do not pass through the baffle opening into the second side 210 of the ink tank 100. Instead, air bubbles entrained in ink pumped into the ink tank via the ink inlet port 108 tend to strike the baffle plate 114 above the baffle opening 212 and float upwards into the headspace of the ink tank, where they can vent to atmosphere via the air vent 109. The baffle plate 114 therefore protects the filter 112 from air bubbles entering the ink tank 100 via the ink inlet port 108. (To the extent that a minimal number of air bubbles reach the filter 112, these can float upwards towards the air vent). The baffle plate 114 additionally protects the float sensors 102 and 104 from air bubbles, as will be explained further below.

When fresh degassed ink from the ink reservoir enters the ink tank 100 via the ink inlet port 108, this ink flows through the baffle opening 212 towards the filter 122 via the lower section 204 of the ink tank. The baffle plate 114 extends into a headspace of the ink tank 100 such that ink contained in the upper section 202 cannot pass from the first side 209 of the ink tank to the second side 210. Since aerated ink in the upper section 202 is relatively immobile and separated (in height) from ink in the lower section 204, this aerated ink diffuses only very slowly towards the lower section 204. Therefore, during normal printing, degassed ink in the lower section 204 remains degassed when replenished with fresh degassed ink from the ink reservoir. The design of the ink tank 100 therefore provides an effective diffusion barrier between the upper and lower sections 202 and 204, making it suitable for gravity control of backpressure at the printhead 4 whilst enabling the use of degassed inks.

The ink level sensor 120 takes the form of a magnetic float sensor having a stem 222 fastened to the lid 206 and extending into the ink tank 100. 'High' and low' float sensors 102 and 104 are movable along the stem 222 between respective fixed stops 224. Each float sensor contains a magnet, which actuates a respective reed switch (not shown) in the stem 222 to indicate a 'high' or 'low' level of ink in the ink tank 100. As described above, the supply pump 30 is actuated or deactuated depending on the level of the float sensors 102 and 104 and the corresponding state of the reed switches. The ink level sensor 120 is positioned at the second side of the ink tank 100 and is thereby protected from air bubbles by the baffle plate 114. Protection of the float sensors 102 and 104 from air bubbles advantageously minimizes false ink level signals from the ink level sensor 109 by avoiding disturbances to the sensitive float sensors.

From the foregoing, it will be appreciated that the ink tank 100 achieves multiple functions: (1) protection of the filter from air bubbles; (2) protection of the ink level sensor from air bubbles; (3) efficient removal of air bubbles from an ink delivery system; and (4) gravity control of ink pressure in an ink delivery system supplied with degassed ink. These and other advantages will be readily apparent to the person skilled in the art.

It will, of course, be appreciated that the present invention has been described by way of example only and that modifications of detail may be made within the scope of the invention, which is defined in the accompanying claims.

The invention claimed is:

1. An ink tank for an ink delivery system comprising:

a housing having an ink inlet port and an ink outlet port;

an air vent communicating with a headspace of the ink tank;

a filter positioned in the housing for filtering ink supplied from the ink tank via the ink outlet port;

a baffle plate positioned in the housing between the ink inlet port and the filter, the baffle plate being configured for directing air bubbles entering the ink tank via the ink inlet port towards the headspace of the ink tank; and an ink level sensor positioned between the baffle plate and the ink outlet port, wherein:

the baffle plate has baffle opening positioned towards a base of the ink tank, thereby allowing ink to flow from the ink inlet port towards the ink outlet port via the baffle opening.

2. The ink tank of claim 1, wherein the ink tank comprises an upper section and a lower section, the lower section having the ink inlet port and the ink outlet port.

3. The ink tank of claim 2, wherein the upper section has a greater volume than the lower section.

4. The ink tank of claim 2, wherein the upper section has a greater cross-sectional area than the lower section.

5. The ink tank of claim 1, wherein the ink outlet port is positioned in a base of the housing and the filter comprises a filter drum positioned over the ink outlet port.

6. The ink tank of claim 1, wherein the baffle plate extends from the base of the housing towards a roof of the ink tank.

7. The ink tank of claim 1, wherein, in use, the baffle plate extends into a headspace of the ink tank.

8. The ink tank of claim 1, wherein the ink inlet port is positioned above the baffle opening.

9. The ink tank of claim 1, wherein the ink level sensor comprises a float level sensor having a stem extending into the ink tank and one or more floats movable along the stem.

10. The ink tank of claim 1, wherein the air vent communicates with a labyrinthine channel defined in a roof of the ink tank.

11. An ink delivery system for an inkjet printer comprising:

an ink tank according to claim 1;

an ink supply reservoir connected to the ink inlet port via an ink supply line;

an inkjet printhead having a printhead inlet port connected to the ink outlet port via an ink delivery line; and a control system coordinating with the ink tank for controlling a hydrostatic pressure of ink delivered to the printhead.

12. The ink delivery system of claim 11, wherein the printhead comprises a printhead outlet port in fluid communication with the ink tank via an ink return line.

13. The ink delivery system of claim 12, wherein the ink return line is connected to the ink supply line.

14. The ink delivery system of claim 12, further comprising a pump and an air intake for depriming the printhead.

15. The ink delivery system of claim 14, wherein air enters the ink tank via the ink inlet port during printhead depriming and/or printhead priming.

16. The ink delivery system of claim 11, wherein the control system is configured to control a height of ink in the ink tank.

17. The ink delivery system of claim 16, wherein the control system controls a supply pump in the ink supply line in response to feedback from one or more ink level sensors in the ink tank.

* * * * *